US008038807B2

(12) United States Patent
Morimoto et al.

(10) Patent No.: US 8,038,807 B2
(45) **Date of Patent: *Oct. 18, 2011**

(54) R-FE-B RARE-EARTH SINTERED MAGNET AND PROCESS FOR PRODUCING THE SAME

(75) Inventors: Hideyuki Morimoto, Osaka (JP); Tomoori Odaka, Osaka (JP); Masao Noumi, Kawanishi (JP)

(73) Assignee: Hitachi Metals, Ltd., Tokyo (JP)

( * ) Notice: Subject to any disclaimer, the term of this patent is extended or adjusted under 35 U.S.C. 154(b) by 318 days.

This patent is subject to a terminal disclaimer.

(21) Appl. No.: 12/160,510

(22) PCT Filed: Jan. 12, 2007

(86) PCT No.: PCT/JP2007/050304

§ 371 (c)(1),
(2), (4) Date: Jul. 10, 2008

(87) PCT Pub. No.: WO2007/088718

PCT Pub. Date: Aug. 9, 2007

(65) Prior Publication Data

US 2010/0231338 A1 Sep. 16, 2010

(30) Foreign Application Priority Data

Jan. 31, 2006 (JP) ..... 2006-022997

(51) Int. Cl.
*H01F 1/057* (2006.01)

(52) U.S. Cl. ..... 148/122; 148/101; 148/302

(58) Field of Classification Search ..... None
See application file for complete search history.

(56) References Cited

U.S. PATENT DOCUMENTS

| | | | |
|---|---|---|---|
| 5,383,978 | A | 1/1995 | Yamamoto et al. |
| 2006/0278517 | A1 | 12/2006 | Machida et al. |
| 2007/0034299 | A1 | 2/2007 | Machida et al. |
| 2008/0257716 | A1 | 10/2008 | Nagata et al. |

(Continued)

FOREIGN PATENT DOCUMENTS

| | | | |
|---|---|---|---|
| JP | 61-281850 | A | 12/1986 |

(Continued)

OTHER PUBLICATIONS

English Translation of JP 62192566.*

(Continued)

*Primary Examiner* — John Sheenan
(74) *Attorney, Agent, or Firm* — Keating & Bennett, LLP

(57) ABSTRACT

First, an R—Fe—B based rare-earth sintered magnet body including, as a main phase, crystal grains of an $R_2Fe_{14}B$ type compound that includes a light rare-earth element RL, which is at least one of Nd and Pr, as a major rare-earth element R is provided. Next, an M layer, including a metallic element M that is at least one element selected from the group consisting of Al, Ga, In, Sn, Pb, Bi, Zn and Ag, is deposited on the surface of the sintered magnet body and then an RH layer, including a heavy rare-earth element RH that is at least one element selected from the group consisting of Dy, Ho and Tb, is deposited on the M layer. Thereafter, the sintered magnet body is heated, thereby diffusing the metallic element M and the heavy rare-earth element RH from the surface of the magnet body deeper inside the magnet.

5 Claims, 4 Drawing Sheets

U.S. PATENT DOCUMENTS

| | | | | |
|---|---|---|---|---|
| 2009/0020193 | A1 * | 1/2009 | Ohta et al. | 148/559 |

FOREIGN PATENT DOCUMENTS

| | | | |
|---|---|---|---|
| JP | 62-188745 | A | 8/1987 |
| JP | 62-192566 | A | 8/1987 |
| JP | 01-117303 | A | 5/1989 |
| JP | 2004-304038 | A | 10/2004 |
| JP | 2005-11973 | A | 1/2005 |
| JP | 2005-175138 | A | 6/2005 |
| JP | 2005-285859 | A | 10/2005 |
| JP | 2005-294558 | A | 10/2005 |
| WO | 2006/100968 | A1 | 9/2006 |
| WO | 2006/112403 | A1 | 10/2006 |

OTHER PUBLICATIONS

English Translation of JP 62192566, Publication date of JP 62192566 is Aug. 24, 1987 (translation previously provided in Office action mailed Sep. 30, 2010).*

Official Communication issued in International Patent Application No. PCT/JP2007/050304, mailed on Apr. 17, 2007.

English translation of the official communication issued in counterpart International Application No. PCT/JP2007/050304, mailed on Aug. 14, 2008.

Official Communication issued in corresponding European Patent Application No. 07706646.2, mailed on Oct. 28, 2009.

* cited by examiner

FIG.1A
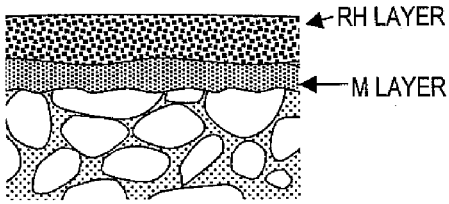
FIG.1B
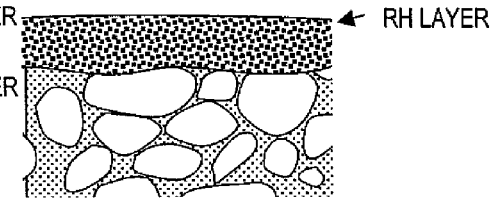
FIG.1C
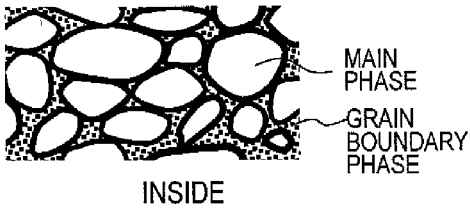
FIG.1D
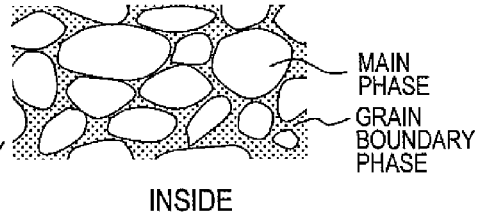
FIG.2A
FIG.2B
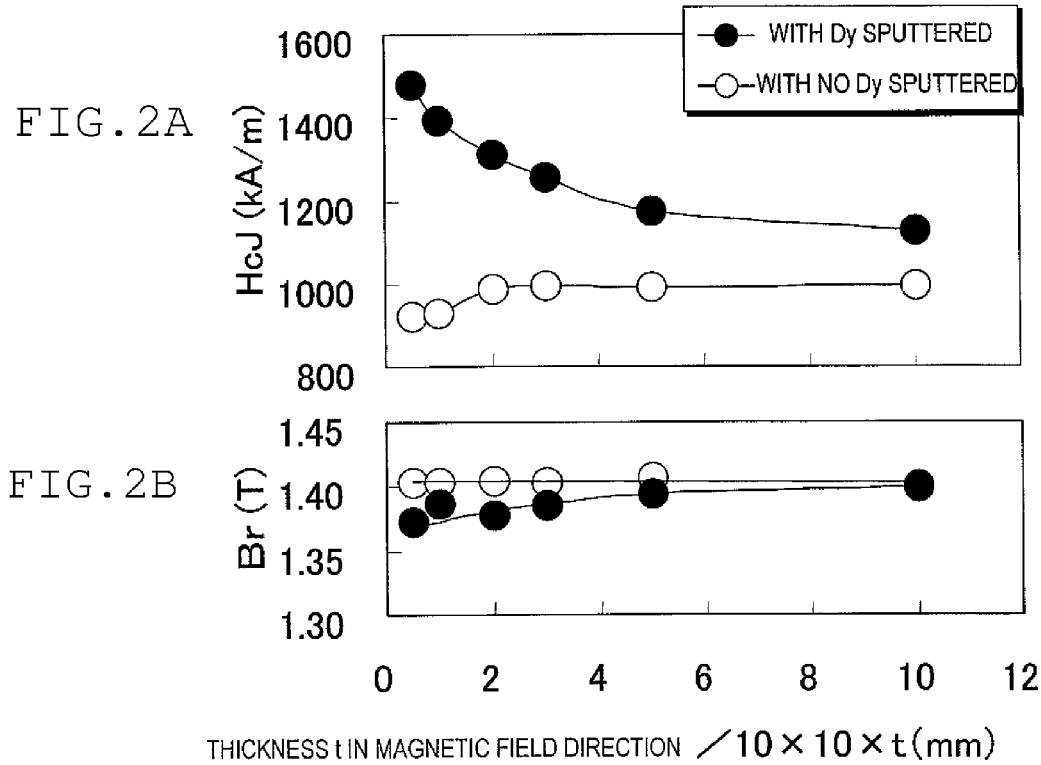

R-FE-B RARE-EARTH SINTERED MAGNET AND PROCESS FOR PRODUCING THE SAME

BACKGROUND OF THE INVENTION

1. Field of the Invention

The present invention relates to an R—Fe—B based rare-earth sintered magnet including crystal grains of an $R_2Fe_{14}B$ type compound (where R is a rare-earth element) as a main phase and a method for producing such a magnet. More particularly, the present invention relates to an R—Fe—B based rare-earth sintered magnet, which includes a light rare-earth element RL (which is at least one of Nd and Pr) as a major rare-earth element R and in which a portion of the light rare-earth element RL is replaced with a heavy rare-earth element RH (which is at least one element selected from the group consisting of Dy, Ho and Tb).

2. Description of the Related Art

An R—Fe—B based rare-earth sintered magnet, including an $Nd_2Fe_{14}B$ type compound phase as a main phase, is known as a permanent magnet with the highest performance, and has been used in various types of motors such as a voice coil motor (VCM) for a hard disk drive and a motor for a hybrid car and in numerous types of consumer electronic appliances. When used in motors and various other devices, the R—Fe—B based rare-earth sintered magnet should exhibit thermal resistance and coercivity that are high enough to withstand an operating environment at an elevated temperature.

As a means for increasing the coercivity of an R—Fe—B based rare-earth sintered magnet, a molten alloy, including a heavy rare-earth element RH as an additional element, may be used. According to this method, the light rare-earth element RL, which is included as a rare-earth element R in an $R_2Fe_{14}B$ phase, is replaced with a heavy rare-earth element RH, and therefore, the magnetocrystalline anisotropy (which is a physical quantity that determines the coercivity) of the $R_2Fe_{14}B$ phase improves. However, although the magnetic moment of the light rare-earth element RL in the $R_2Fe_{14}B$ phase has the same direction as that of Fe, the magnetic moments of the heavy rare-earth element RH and Fe have mutually opposite directions. That is why the greater the percentage of the light rare-earth element RL replaced with the heavy rare-earth element RH, the lower the remanence $B_r$ would be.

Meanwhile, as the heavy rare-earth element RH is one of rare natural resources, its use is preferably cut down as much as possible. For these reasons, the method in which the light rare-earth element RL is entirely replaced with the heavy rare-earth element RH is not preferred.

To get the coercivity increased effectively with the addition of a relatively small amount of the heavy rare-earth element RH, it was proposed that an alloy or compound powder, including a lot of the heavy rare-earth element RH, be added to a main phase material alloy powder including a lot of the light rare-earth element RL and then the mixture be compacted and sintered. According to this method, the heavy rare-earth element RH is distributed a lot in the vicinity of the grain boundary of the $R_2Fe_{14}B$ phase, and therefore, the magnetocrystalline anisotropy of the $R_2Fe_{14}B$ phase can be improved efficiency on the outer periphery of the main phase. The R—Fe—B based rare-earth sintered magnet has a nucleation-type coercivity generating mechanism. That is why if a lot of the heavy rare-earth element RH is distributed on the outer periphery of the main phase (i.e., near the grain boundary thereof), the magnetocrystalline anisotropy of all crystal grains is improved, the nucleation of reverse magnetic domains can be minimized, and the coercivity increases as a result. At the core of the crystal grains that does not contribute to increasing the coercivity, no light rare-earth element RL is replaced with the heavy rare-earth element RH. Consequently, the decrease in remanence $B_r$ can be minimized there, too.

If this method is actually adopted, however, the heavy rare-earth element RH has an increased diffusion rate during the sintering process (which is carried out at a temperature of 1,000° C. to 1,200° C. on an industrial scale) and may diffuse to reach the core of the crystal grains, too. For that reason, it is not easy to obtain the expected crystal structure.

As another method for increasing the coercivity of an R—Fe—B based rare-earth sintered magnet, a metal, an alloy or a compound including a heavy rare-earth element RH is deposited on the surface of the sintered magnet and then thermally treated and diffused. Then, the coercivity could be recovered or increased without decreasing the remanence so much (see Patent Documents Nos. 1, 2 and 3).

Patent Document No. 1 teaches forming a thin-film alloy layer, including 1.0 at % to 50.0 at % of at least one element that is selected from the group consisting of Ti, W, Pt, Au, Cr, Ni, Cu, Co, Al, Ta and Ag and R' as the balance (which is at least one element selected from the group consisting of Ce, La, Nd, Pr, Dy, Ho and Tb), on the surface of a sintered magnet body to be ground.

Patent Document No. 2 discloses that a metallic element R (which is at least one rare-earth element selected from the group consisting of Y, Nd, Dy, Pr, Ho and Tb) is diffused to a depth that is at least equal to the radius of crystal grains exposed on the uppermost surface of a small-sized magnet, thereby repairing the damage done on the machined surface and increasing (BH) max.

Patent Document No. 3 discloses that the magnetic properties could be recovered by depositing a CVD film consisting mostly of a rare-earth element on the surface of a magnet with a thickness of 2 mm or less.

Patent Document No. 1: Japanese Patent Application Laid-Open Publication No. 62-192566

Patent Document No. 2: Japanese Patent Application Laid-Open Publication No. 2004-304038

Patent Document No. 3: Japanese Patent Application Laid-Open Publication No. 2005-285859

All of the techniques disclosed in Patent Documents Nos. 1, 2 and 3 were developed to repair the damage done on the machined surface of a sintered magnet. That is why the metallic element, diffused inward from the surface, can reach no farther than a surface region of the sintered magnet. For that reason, if the magnet had a thickness of 3 mm or more, the coercivity could hardly be increased effectively.

Magnets for EPS and HEV motors, which are expected to expand their markets in the near future, need to be rare-earth sintered magnets with a thickness of at least 3 mm and preferably 5 mm or more. To increase the coercivity of a sintered magnet with such a thickness, a technique for diffusing the heavy rare-earth element RH efficiently throughout the inside of the R—Fe—B based rare-earth sintered magnet with a thickness of 3 mm or more needs to be developed.

SUMMARY OF THE INVENTION

In order to overcome the problems described above, preferred embodiments of the present invention provide an R—Fe—B based rare-earth sintered magnet, in which a small amount of heavy rare-earth element RH is used efficiently and is diffused on the outer periphery of crystal grains of the main phase anywhere in the magnet, even if the magnet is relatively thick.

An R—Fe—B based rare-earth sintered magnet according to a preferred embodiment of the present invention includes, as a main phase, crystal grains of an $R_2Fe_{14}B$ type compound that includes a light rare-earth element RL, which is at least one of Nd and Pr, as a major rare-earth element R. The magnet further includes a metallic element M and a heavy rare-earth element RH, both of which have been introduced from its surface by grain boundary diffusion. The metallic element M is at least one element that is selected from the group consisting of Al, Ga, In, Sn, Pb, Bi, Zn and Ag, and the heavy rare-earth element RH is at least one element that is selected from the group consisting of Dy, Ho and Tb.

In one preferred embodiment, the concentrations of the metallic element M and the heavy rare-earth element RH are higher on a grain boundary than inside the crystal grains of the main phase.

In another preferred embodiment, the magnet has a thickness of about 3 mm to about 10 mm and the heavy rare-earth element RH has diffused to reach a depth of about 0.5 mm or more as measured from the surface.

In another preferred embodiment, the weight of the heavy rare-earth element RH accounts for about 0.1% to about 1.0% of that of the R—Fe—B based rare-earth sintered magnet.

In another preferred embodiment, the weight ratio M/RH of the content of the metallic element M to that of the heavy rare-earth element RH is from about 1/100 to about 5/1.

In another preferred embodiment, the light rare-earth element RL is replaced with RH at least partially on outer peripheries of the crystal grains of the $R_2Fe_{14}B$ type compound.

In another preferred embodiment, at least a portion of the surface is covered with an RH layer including the heavy rare-earth element RH, and at least a portion of an M layer, including the metallic element M, is present between the surface and the RH layer.

In another preferred embodiment, the heavy rare-earth element RH has a concentration profile in the thickness direction of the magnet.

A method for producing an R—Fe—B based rare-earth sintered magnet according to a preferred embodiment of the present invention includes the steps of: providing an R—Fe—B based rare-earth sintered magnet body including, as a main phase, crystal grains of an $R_2Fe_{14}B$ type compound that includes a light rare-earth element RL, which is at least one of Nd and Pr, as a major rare-earth element R; depositing an M layer, including a metallic element M that is at least one element selected from the group consisting of Al, Ga, In, Sn, Pb, Bi, Zn and Ag, on the surface of the R—Fe—B based rare-earth sintered magnet body; depositing an RH layer, including a heavy rare-earth element RH that is at least one element selected from the group consisting of Dy, Ho and Tb, on the M layer; and heating the R—Fe—B based rare-earth sintered magnet body, thereby diffusing the metallic element M and the heavy rare-earth element RH from the surface of the R—Fe—B based rare-earth sintered magnet body deeper inside the magnet.

In one preferred embodiment, the R—Fe—B based rare-earth sintered magnet body has a thickness of about 3 mm to about 10 mm.

In another preferred embodiment, the method includes the step of setting the weight of the RH layer yet to be diffused within the range of about 0.1% to about 1.0% of the weight of the R—Fe—B based rare-earth sintered magnet body.

In another preferred embodiment, the method includes the step of setting the temperature of the R—Fe—B based rare-earth sintered magnet body during diffusion within the range of about 300° C. to less than about 1,000° C.

In another preferred embodiment, the steps of depositing the M layer and the RH layer are carried out by a vacuum evaporation process, a sputtering process, an ion plating process, an ion vapor deposition (IVD) process, an electrochemical vapor deposition (EVD) process or a dipping process.

According to preferred embodiments of the present invention, even if the sintered magnet body has a thickness of about 3 mm or more, crystal grains of a main phase, including a heavy rare-earth element RH at a high concentration on their outer peripheries, can be distributed efficiently inside the sintered magnet body, too. As a result, a high-performance magnet that has both high remanence and high coercivity alike can be provided.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 1A is a cross-sectional view schematically illustrating a cross section of an R—Fe—B based rare-earth sintered magnet, of which the surface is coated with a stack of an M layer and an RH layer; FIG. 1B is a cross-sectional view schematically illustrating a cross section of an R—Fe—B based rare-earth sintered magnet, of which the surface is coated with only an RH layer, for the purpose of comparison; FIG. 1C is a cross-sectional view schematically illustrating the internal texture of the magnet shown in FIG. 1A that has been subjected to a diffusion process; and FIG. 1D is a cross-sectional view schematically illustrating the internal texture of the magnet shown in FIG. 1B that has been subjected to the diffusion process.

FIG. 2A is a graph showing how the coercivity $H_{cJ}$ changed with the thickness t of a sintered magnet in a situation where a sample including a Dy layer on its surface and a sample including no Dy layer there were thermally treated at 900° C. for 30 minutes, and FIG. 2B is a graph showing how the remanence $B_r$ changed with the thickness t of the sintered magnet in a situation where such samples were thermally treated at 900° C. for 30 minutes.

DETAILED DESCRIPTION OF THE PREFERRED EMBODIMENTS

Figure 3C:
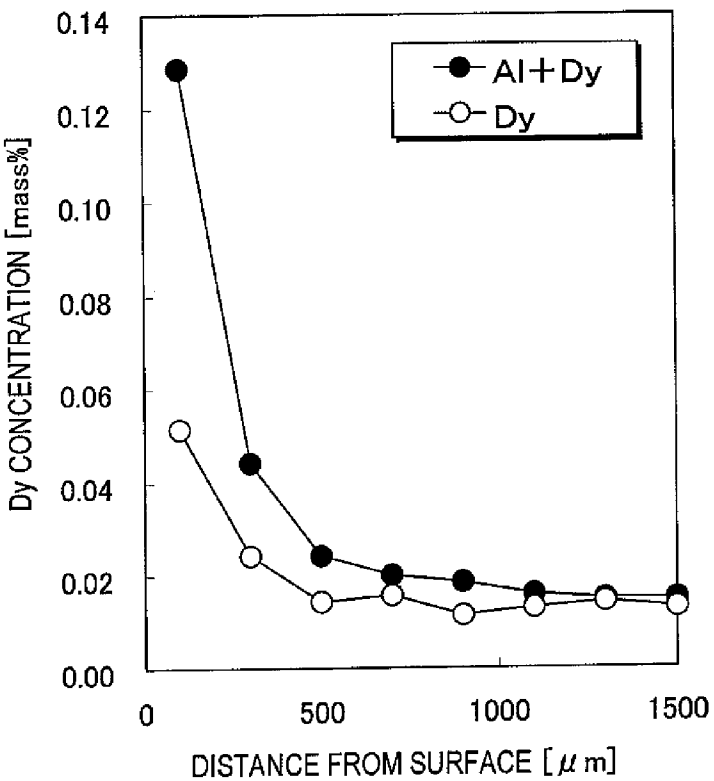
FIG. 3C is a graph showing the Dy concentration profiles of the samples shown in FIGS. 3A and 3B, which were figured out by an EPMA analysis at a beam diameter $\phi$ of 100 μm.

An R—Fe—B based rare-earth sintered magnet according to a preferred embodiment of the present invention includes a metallic element M and a heavy rare-earth element RH that have both been introduced from the surface of a sintered body by a grain boundary diffusion process. In this case, the metallic element M is at least one element that is selected from the group consisting of Al, Ga, In, Sn, Pb, Bi, Zn and Ag, while the heavy rare-earth element RH is at least one element that is selected from the group consisting of Dy, Ho and Tb.

The R—Fe—B based rare-earth sintered magnet according to a preferred embodiment of the present invention is preferably produced by depositing a layer including the metallic element M (which will be referred to herein as an "M layer") and a layer including the heavy rare-earth element RH (which will be referred to herein as an "RH layer") in this order on the surface of an R—Fe—B based rare-earth sintered magnet and then diffusing the metallic element M and the heavy rare-earth element RH from the surface of the sintered body inward.

FIG. 1A schematically illustrates a cross section of an R—Fe—B based rare-earth sintered magnet, of which the surface is coated with a stack of an M layer and an RH layer. For the purpose of comparison, FIG. 1B schematically illustrates a cross section of a conventional R—Fe—B based rare-earth sintered magnet, of which the surface is coated with only an RH layer.

The diffusion process according to a preferred embodiment of the present invention is carried out by heating a sintered body including a stack of an M layer and an RH layer on the surface. As a result of this heating, the metallic element M with a relatively low melting point diffuses inward through the grain boundary inside the sintered body and then the heavy rare-earth element RH diffuses through the grain boundary inside the sintered body. The metallic element M that starts diffusing earlier lowers the melting point of the grain boundary phase (i.e., an R-rich grain boundary phase), and therefore, the diffusion of the heavy rare-earth element RH through the grain boundary would be promoted compared to the situation where the M layer is not deposited. Consequently, the heavy rare-earth element RH can be diffused more efficiently inside the sintered body even at a lower temperature than in a magnet including no M layer.

FIG. 1C schematically illustrates the internal texture of the magnet shown in FIG. 1A that has been subjected to the diffusion process, while FIG. 1D schematically illustrates the internal texture of the magnet shown in FIG. 1B that has been subjected to the diffusion process. As schematically illustrated in FIG. 1C, the heavy rare-earth element RH has diffused through the grain boundary to enter the outer periphery of the main phase. On the other hand, as schematically illustrated in FIG. 1D, the heavy rare-earth element RH that has been supplied on the surface has not diffused inside the magnet.

If the grain boundary diffusion of the heavy rare-earth element RH is promoted in this manner due to the action of the metallic element M, the rate at which the heavy rare-earth element RH is diffusing inward and entering the inside of the magnet will be higher than the rate at which the same element is diffusing and entering the main phase that is located in the vicinity of the surface of the sintered magnet body. Such diffusion of the heavy rare-earth element RH inside the main phase will be referred to herein as "volume diffusion". The presence of the M layer causes the grain boundary diffusion more preferentially than the volume diffusion, thus eventually reducing the volume diffusion. According to a preferred embodiment of the present invention, the concentrations of the metallic element M and the heavy rare-earth element RH are higher on the grain boundary than inside the main phase crystal grains as a result of the grain boundary diffusion. Specifically, according to a preferred embodiment of the present invention, the heavy rare-earth element RH can easily diffuse to reach a depth of about 0.5 mm or more as measured from the surface of the magnet.

According to a preferred embodiment of the present invention, the heat treatment for diffusing the metallic element M is preferably carried out at a temperature that is at least equal to the melting point of the metal M but less than about 1,000° C. Optionally, to further promote the grain boundary diffusion of the heavy rare-earth element RH after the metal M has been diffused sufficiently, the heat treatment temperature may be raised to an even higher temperature of about 800° C. to less than about 1,000° C., for example.

By conducting such a heat treatment, the light rare-earth element RL included in the $R_2Fe_{14}B$ main phase crystal grains can be partially replaced with the heavy rare-earth element RH that has been diffused from the surface of the sintered body, and a layer including the heavy rare-earth element RH at a relatively high concentration (with a thickness of about 1 nm, for example) can be formed on the outer periphery of the $R_2Fe_{14}B$ main phase.

The R—Fe—B based rare-earth sintered magnet has a nucleation type coercivity generating mechanism. Therefore, if the magnetocrystalline anisotropy is increased on the outer periphery of a main phase, the nucleation of reverse magnetic domains can be reduced in the vicinity of the grain boundary phase surrounding the main phase. As a result, the coercivity $H_{cJ}$ of the main phase can be increased effectively as a whole. According to a preferred embodiment of the present invention, the heavy rare-earth replacement layer can be formed on the outer periphery of the main phase not only in a surface region of the sintered magnet body but also deep inside the magnet. Consequently, the magnetocrystalline anisotropy can be increased in the entire magnet and the coercivity $H_{cJ}$ of the overall magnet increases sufficiently. Therefore, according to a preferred embodiment of the present invention, even if the amount of the heavy rare-earth element RH consumed is small, the heavy rare-earth element RH can still diffuse and penetrate deep inside the sintered body. And by forming $RH_2Fe_{14}B$ efficiently on the outer periphery of the main phase, the coercivity $H_{cJ}$ can be increased with the decrease in remanence $B_r$ minimized.

It should be noted that the magnetocrystalline anisotropy of $Tb_2Fe_{14}B$ is higher than that of $Dy_2Fe_{14}B$ and is about three times as high as that of $Nd_2Fe_{14}B$. For that reason, the heavy rare-earth element RH to replace the light rare-earth element RL on the outer periphery of the main phase is preferably Tb rather than Dy.

As can be seen easily from the foregoing description, according to a preferred embodiment of the present invention, there is no need to add the heavy rare-earth element RH to the material alloy. That is to say, a known R—Fe—B based rare-earth sintered magnet, including a light rare-earth element RL (which is at least one of Nd and Pr) as the rare-earth element R, is provided, and a low-melting metal and a heavy rare-earth element are diffused inward from the surface of the magnet. If only the conventional heavy rare-earth layer were formed on the surface of the magnet, it would be difficult to diffuse the heavy rare-earth element deep inside the magnet even at an elevated diffusion temperature. However, according to a preferred embodiment of the present invention, by diffusing a low-melting metal such as Al earlier, the grain boundary diffusion of the heavy rare-earth element RH can be promoted. As a result, the heavy rare-earth element can also be supplied efficiently to the outer periphery of the main phase located deep inside the magnet.

According to the results of experiments the present inventors carried out, the weight ratio M/RH of the M layer to the RH layer on the surface of the sintered magnet body preferably falls within the range of about 1/100 to about 5/1, more preferably from about 1/20 to about 2/1. By setting the weight ratio within such a range, the metal M can promote the diffusion of the heavy rare-earth element RH effectively. As a result, the heavy rare-earth element RH can be diffused inside the magnet efficiently and the coercivity can be increased effectively.

The weight of the RH layer deposited on the surface of the sintered magnet body, i.e., the total weight of the heavy rare-earth element RH included in the magnet, is preferably adjusted so as to account for about 0.1 wt % to about 1 wt % of the entire magnet. This range is preferred for the following reasons. Specifically, if the weight of the RH layer were less than about 0.1 wt % of the magnet, the amount of the heavy rare-earth element RH would be too small to diffuse. That is why if the magnet thickened, the heavy rare-earth element RH could not be diffused to the outer periphery of every main phase included in the magnet. On the other hand, if the weight of the RH layer exceeded about 1 wt % of the magnet, then the heavy rare-earth element RH would be in excess of the amount needed to form an RH concentrated layer on the outer periphery of the main phase. Also, if an excessive amount of heavy rare-earth element RH were supplied, then RH would diffuse and enter the main phase to possibly decrease the remanence $B_r$.

According to a preferred embodiment of the present invention, even if the magnet has a thickness of about 3 mm or more, the remanence $B_r$ and coercivity $H_{cJ}$ of the magnet can be both increased by adding a very small amount of heavy rare-earth element RH and a high-performance magnet with magnetic properties that never deteriorate even at high temperatures can be provided. Such a high-performance magnet contributes significantly to realizing an ultra small high-output motor. The effects and advantages of the present invention that utilize the grain boundary diffusion are achieved particularly significantly in a magnet with a thickness of about 10 mm or less.

Hereinafter, a preferred embodiment of a method for producing an R—Fe—B based rare-earth sintered magnet according to the present invention will be described.

Material Alloy

First, an alloy including about 25 mass % to about 40 mass % of a light rare-earth element RL, about 0.6 mass % to about 1.6 mass % of B (boron) and Fe and inevitably contained impurities as the balance is provided. A portion of B may be replaced with C (carbon) and a portion (about 50 at % or less) of Fe may be replaced with another transition metal element such as Co or Ni. For various purposes, this alloy may contain about 0.01 mass % to about 1.0 mass % of at least one additive element that is selected from the group consisting of Al, Si, Ti, V, Cr, Mn, Ni, Cu, Zn, Ga, Zr, Nb, Mo, Ag, In, Sn, Hf, Ta, W, Pb and Bi.

Such an alloy is preferably made by quenching a melt of a material alloy by a strip casting process, for example. Hereinafter, a method of making a rapidly solidified alloy by a strip casting process will be described.

First, a material alloy with the composition described above is melted by an induction heating process within an argon atmosphere to obtain a melt of the material alloy. Next, this melt is kept heated at about 1,350° C. and then quenched by a single roller process, thereby obtaining a flake-like alloy block with a thickness of about 0.3 mm. Then, the alloy block thus obtained is pulverized into flakes with a size of about 1 mm to about 10 mm before being subjected to the next hydrogen pulverization process. Such a method of making a material alloy by a strip casting process is disclosed in U.S. Pat. No. 5,383,978, for example.

Coarse Pulverization Process

Next, the material alloy block that has been coarsely pulverized into flakes is loaded into a hydrogen furnace and then subjected to a hydrogen decrepitation process (which will be sometimes referred to herein as a "hydrogen pulverization process") within the hydrogen furnace. When the hydrogen pulverization process is over, the coarsely pulverized alloy powder is preferably unloaded from the hydrogen furnace in an inert atmosphere so as not to be exposed to the air. This should prevent the coarsely pulverized powder from being oxidized or generating heat and would eventually improve the magnetic properties of the resultant magnet.

As a result of this hydrogen pulverization process, the rare-earth alloy is pulverized to sizes of about 0.1 mm to several millimeters with a mean particle size of about 500 μm or less. After the hydrogen pulverization, the decrepitated material alloy is preferably further crushed to finer sizes and cooled. If the material alloy unloaded still has a relatively high temperature, then the alloy should be cooled for a longer time.

Fine Pulverization Process

Next, the coarsely pulverized powder is finely pulverized with a jet mill pulverizing machine. A cyclone classifier is connected to the jet mill pulverizing machine for use in this preferred embodiment. The jet mill pulverizing machine is fed with the rare-earth alloy that has been coarsely pulverized in the coarse pulverization process (i.e., the coarsely pulverized powder) and causes the powder to be further pulverized by its pulverizer. The powder, which has been pulverized by the pulverizer, is then collected in a collecting tank by way of the cyclone classifier. In this manner, a finely pulverized powder with sizes of about 0.1 μm to about 20 μm (typically about 3 μm to about 5 μm) can be obtained. The pulverizing machine for use in such a fine pulverization process does not have to be a jet mill but may also be an attritor or a ball mill. Optionally, a lubricant such as zinc stearate may be added as an aid for the pulverization process.

Press Compaction Process

In this preferred embodiment, about 0.3 wt % of lubricant is added to the magnetic powder obtained by the method described above and then they are mixed in a rocking mixer, thereby coating the surface of the alloy powder particles with the lubricant. Next, the magnetic powder prepared by the method described above is compacted under an aligning magnetic field using a known press machine. The aligning magnetic field to be applied may have a strength of about 1.5 to about 1.7 tesla (T), for example. Also, the compacting pressure is set such that the green compact has a green density of about 4 g/cm$^3$ to about 4.5 g/cm$^3$.

Sintering Process

The powder compact described above is preferably sequentially subjected to the process of maintaining the compact at a temperature of about 650° C. to about 1,000° C. for about 10 to about 240 minutes and then to the process of further sintering the compact at a higher temperature (of about 1,000° C. to about 1,200° C., for example) than in the maintaining process. Particularly when a liquid phase is produced during the sintering process (i.e., when the temperature is in the range of about 650° C. to about 1,000° C.), the R-rich phase on the grain boundary starts to melt to produce the liquid phase. Thereafter, the sintering process advances to form a sintered magnet eventually. The sintered magnet may be subjected to an aging treatment (at a temperature of about 500° C. to about 1,000° C.) if necessary.

Metal Diffusion Process

Next, a layer of the metal M and a layer of the heavy rare-earth element RH are stacked in this order on the surface of the sintered magnet thus obtained. To allow the metal M to perform the function of promoting the diffusion of the heavy rare-earth element RH and making the element diffuse and permeate deeper into the magnet more efficiently to achieve the effect of increasing the coercivity, these metal layers are preferably deposited to such thicknesses that would realize the weight ratio described above.

The metal layer may be formed by any deposition process. For example, one of various thin-film deposition techniques such as a vacuum evaporation process, a sputtering process, an ion plating process, an ion vapor deposition (IND) process, an electrochemical vapor deposition (EVD) process and a dipping process may be adopted.

To diffuse the metallic element from the metal layer deeper inside the magnet, the heat treatment may be carried out in two stages as described above. That is to say, first, the magnet may be heated to a temperature that is higher than the melting point of the metal M to promote the diffusion of the metal M preferentially. After that, heat treatment may be performed to cause the grain boundary diffusion of the heavy rare-earth element RH.

FIG. 2 is a graph showing how the remanence $B_r$ and coercivity $H_{cJ}$ changed with the thickness of the magnet in a situation where only a Dy layer (with a thickness of about 2.5 μm) was formed by a sputtering process on the surface of a sintered magnet and thermally treated at about 900° C. for about 30 minutes. As can be seen from FIG. 2, when the magnet had a small thickness of less than about 3 mm, the coercivity $H_{cJ}$ increased sufficiently. However, the thicker the magnet, the less effectively the coercivity $H_{cJ}$ increased. This is because Dy has a short diffusion distance. That is to say, the thicker the sintered magnet, the greater the percentage of the portion where replacement by Dy was incomplete.

On the other hand, according to the present invention, the grain boundary diffusion of the heavy rare-earth element RH is promoted by using at least one metallic element M that is selected from the group consisting of Al, Ga, In, Sn, Pb, Bi, Zn and Ag. That is why the heavy rare-earth element RH can permeate deeper into the thick magnet and the performance of the magnet can be improved even at a lower diffusion temperature.

Hereinafter, specific examples of preferred embodiments of the present invention will be described.

EXAMPLES

Example 1

An alloy ingot that had been prepared so as to have a composition consisting of about 14.6 at % of Nd, about 6.1 at % of B, about 1.0 at % of Co, about 0.1 at % of Cu, about 0.5 at % of Al and Fe as the balance was melted by a strip caster and then cooled and solidified, thereby making thin alloy flakes with thicknesses of about 0.2 mm to about 0.3 mm.

Next, a container was loaded with those thin alloy flakes and then introduced into a furnace for a hydrogen absorption, which was filled with a hydrogen gas atmosphere at a pressure of about 500 kPa. In this manner, hydrogen was occluded into the thin alloy flakes at room temperature and then released. By performing such a hydrogen process, the alloy flakes were decrepitated to obtain a powder in indefinite shapes with sizes of about 0.15 mm to about 0.2 mm.

Thereafter, about 0.05 wt % of zinc stearate was added to the coarsely pulverized powder obtained by the hydrogen process and then the mixture was pulverized with a jet mill to obtain a fine powder with a size of approximately 4 μm.

The fine powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at about 1,020° C. for four hours in a vacuum furnace, thus obtaining sintered blocks, which were then machined and cut into sintered magnet bodies with a thickness of about 3 mm, a length of about 10 mm and a width of about 10 mm.

Subsequently, a metal layer was deposited on the surface of the sintered magnet bodies using a magnetron sputtering apparatus. Specifically, the following process steps were carried out.

First, the deposition chamber of the sputtering apparatus was evacuated to reduce its pressure to about $6\times10^{-4}$ Pa, and then was supplied with high-purity Ar gas with its pressure maintained at about 1 Pa. Next, an RF power of about 300 W was applied between the electrodes of the deposition chamber, thereby performing a reverse sputtering process on the surface of the sintered magnet bodies for five minutes. This reverse sputtering process was carried out to clean the surface of the sintered magnet bodies by removing a natural oxide film from the surface of the magnets.

Subsequently, a DC power of about 500 W and an RF power of about 30 W were applied between the electrodes of the deposition chamber, thereby causing sputtering on the surface of an Al target and depositing an Al layer to a thickness of about 1.0 μm on the surface of the sintered magnet bodies. Thereafter, sputtering is caused on the surface of a Dy target in the same deposition chamber, thereby depositing a Dy layer to a thickness of about 4.5 μm on the Al layer.

Next, the sintered magnet bodies, including the stack of these metal layers on the surface, were subjected to a first-stage heat treatment process at about 680° C. for about 30 minutes, and to a second-stage heat treatment process at about 900° C. for about 60 minutes, continuously within a reduced-pressure atmosphere of about $1\times10^{-2}$ Pa. These heat treatment processes were carried out to diffuse the metallic elements from the stack of the metal layers deeper inside the sintered magnet bodies through the grain boundary. Thereafter, the sintered magnet bodies were subjected to an aging treatment at about 500° C. for about two hours to obtain a sample representing a first specific example of a preferred embodiment of the present invention. In the meantime, samples representing first through third comparative examples were also made. The manufacturing process of the first through third comparative examples was different from that of the first specific example of a preferred embodiment of the present invention in that the process step of depositing the Al layer and the heat treatment process at about 680° C. for about 30 minutes were omitted. The first through third comparative examples themselves were different in the thickness of the Dy layer (i.e., the amount of Dy added).

These samples were magnetized with a pulsed magnetizing field with a strength of about 3 MA/m and then their magnetic properties were measured using a BH tracer. The magnetic properties (including remanence $B_r$ and coercivity $H_{cJ}$) of the first through third comparative examples and the first specific example of a preferred embodiment of the present invention thus measured are shown in the following Table 1.

TABLE 1

| | Magnet's dimensions | 1st layer (M layer) sputtered | | 2nd layer (RH layer) sputtered | | | |
|---|---|---|---|---|---|---|---|
| | (mm) 10 × 10 × t | Element | Thickness (μm) | Element | Thickness (μm) | Br (T) | HcJ (MA/m) |
| Cmp. Ex. 1 | 3.0 | | | | | 1.40 | 1.00 |
| Cmp. Ex. 2 | 3.0 | | | Dy | 4.5 | 1.38 | 1.32 |
| Cmp. Ex. 3 | 3.0 | | | Dy | 7.5 | 1.37 | 1.37 |
| Ex. 1 | 3.0 | Al | 1.0 | Dy | 4.5 | 1.39 | 1.41 |

As is clear from the results shown in Table 1, the first specific example of a preferred embodiment of the present invention, including the Al layer under the Dy layer, exhibited high coercivity $H_{cJ}$, which increased about 40% compared to that of the first comparative example that had been subjected to only the aging treatment, and had only slightly decreased remanence $B_r$. It was also confirmed that the coercivity $H_{cJ}$ of the first specific example was higher than that of the second comparative example in which only the Dy layer was deposited and diffused with no Al layer. Likewise, the coercivity $H_{cJ}$ of the first specific example was also higher than that of the third comparative example in which a thicker Dy layer was deposited with no Al layer.

The present inventors believe that these beneficial effects were achieved because by forming and diffusing in advance the Al layer, the grain boundary diffusion of Dy was promoted and Dy permeated through the grain boundary deep inside the magnet.

Figure 3A:
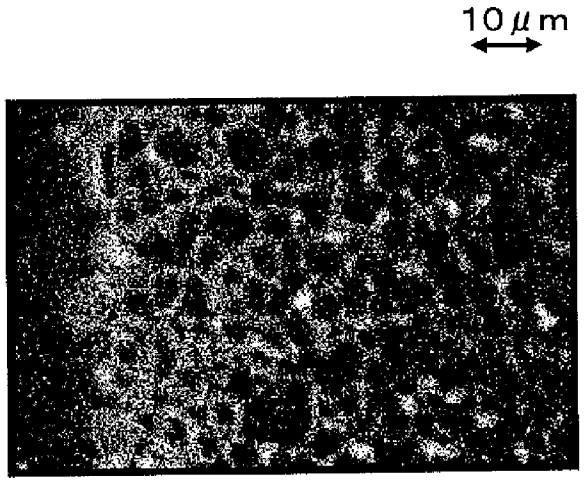
FIG. 3A is a mapping photograph showing the distribution of Dy in a sample in which Al and Dy layers were stacked one upon the other and which was thermally treated.
Figure 3B:
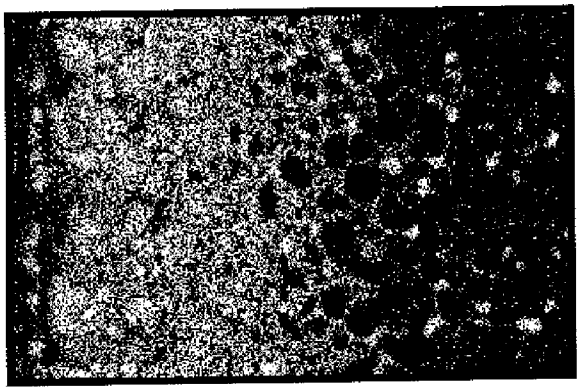
FIG. 3B is a mapping photograph showing the distribution of Dy in a sample in which only a Dy layer was deposited and which was thermally treated.

FIG. 3A is a mapping photograph showing the concentration distribution of Dy in a sample in which an Al layer (with a thickness of about 1.0 μm) and a Dy layer (with a thickness of about 4.5 μm) were stacked one upon the other and which was thermally treated at about 900° C. for about 120 minutes. On the other hand, FIG. 3B is a mapping photograph showing the concentration distribution of Dy in a sample in which only a Dy layer was deposited to a thickness of about 4.5 μm and which was thermally treated at about 900° C. for about 120 minutes. In FIGS. 3A and 3B, the surface of the magnet is located on the left-hand side and the white dots indicate the presence of Dy. As can be seen easily by comparing FIGS. 3A and 3B with each other, in the sample including no Al layer, Dy is present densely in the vicinity of the surface of the magnet on the left-hand side of the photo shown in FIG. 3B. This should be because the grain boundary diffusion was not promoted and volume diffusion was produced significantly. The volume diffusion would decrease the remanence $B_r$.

FIG. 3C is a graph showing the Dy concentration profiles of the samples shown in FIGS. 3A and 3B, which were figured out by an EPMA analysis at a beam diameter ϕ of 100 μm, an acceleration voltage of 25 kV and a beam current of 200 nA. In the graph shown in FIG. 3C, the data ● were collected from the sample shown in FIG. 3A, while the data ○ were collected from the sample shown in FIG. 3B. As can be seen from these concentration profiles, Dy diffused to deeper locations in the sample including the Al layer (with a thickness of about 1.0 μm).

Figure 4A:
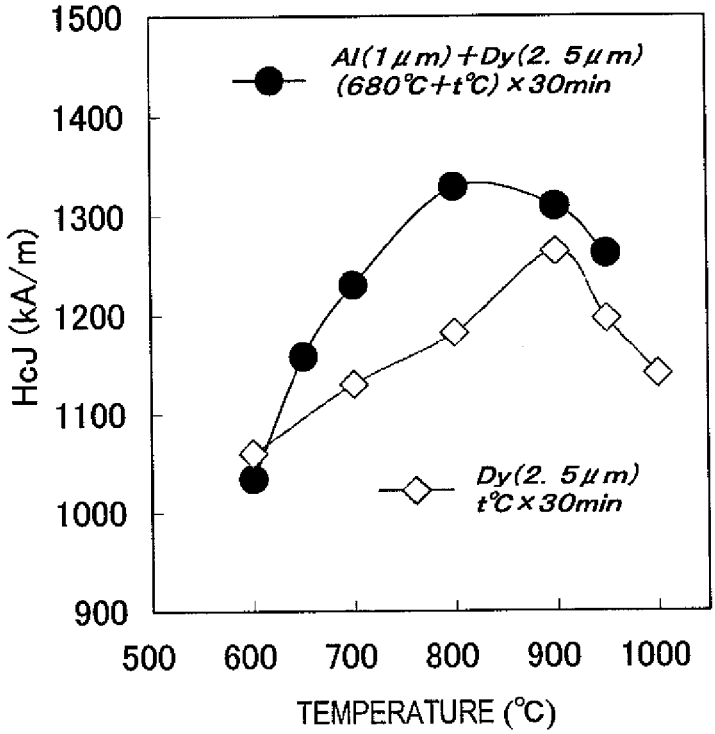
FIG. 4A is a graph showing relations between the coercivity $H_{cJ}$ and heat treatment temperature.
Figure 4B:
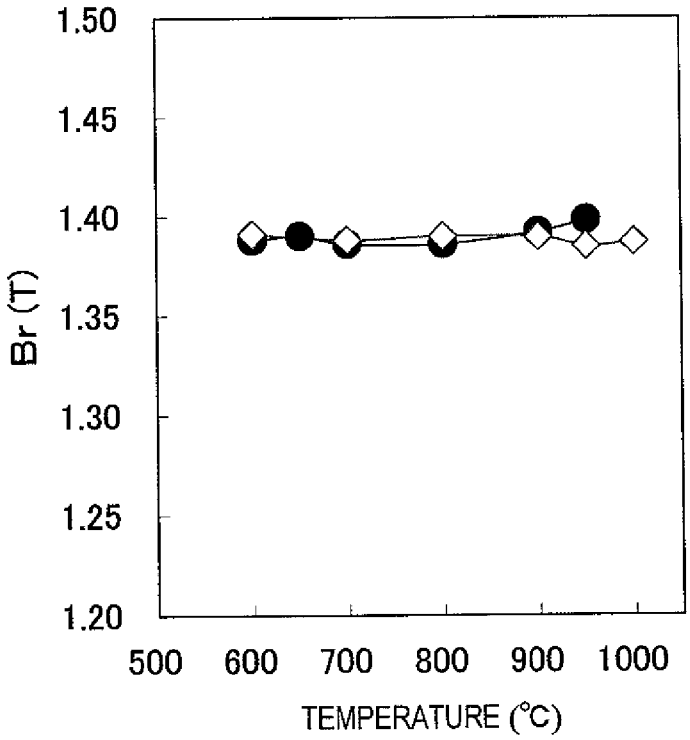
FIG. 4B is a graph showing relationships between the remanence $B_r$ and heat treatment temperature.

FIG. 4A is a graph showing relations between the coercivity $H_{cJ}$ and heat treatment temperature (i.e., the temperature of the second-stage heat treatment process if the heat treatment was carried out in two stages) for a sample including the stack of the Al layer (with a thickness of about 1.0 μm) and the Dy layer (with a thickness of about 2.5 μm) and another sample including only the Dy layer (with a thickness of about 2.5 μm). FIG. 4B is a graph showing relations between the remanence $B_r$ and the heat treatment temperature for these two samples. As can be seen from these graphs, even if the heat treatment for diffusing Dy was carried out at a lower temperature, the sample including the Al layer still achieved high coercivity $H_{cJ}$.

Examples 2 to 6

First, by performing the same manufacturing process steps as those of the first specific example described above, a number of sintered magnet bodies with a thickness of about 5 mm, a length of about 10 mm and a width of about 10 mm were made. Next, on each of these sintered magnet bodies, an Al, Bi, Zn, Ag or Sn layer was deposited to a thickness of about 2 μm, about 0.6 μm, about 1.0 μm, about 0.5 μm or about 1.0 μm, respectively, by a sputtering process.

Thereafter, on each of these sintered magnet bodies including one of these metal layers, a Dy layer was deposited to a thickness of about 8.0 μm by a sputtering process. That is to say, each sample included a layer of one of the five metals Al, Bi, Zn, Ag and Sn (i.e., the M layer) between the Dy layer and the sintered magnet body.

Next, the sintered magnet bodies, including the stack of these metal layers on the surface, were subjected to a first-stage heat treatment process at a temperature of about 300° C. to about 800° C. for about 30 minutes, and to a second-stage heat treatment process at about 900° C. for about 60 minutes, continuously within a reduced-pressure atmosphere of about $1\times10^{-2}$ Pa. These heat treatment processes were carried out to diffuse the metallic elements from the stack of the metal layers deeper inside the sintered magnet bodies through the grain boundary. Thereafter, the sintered magnet bodies were subjected to an aging treatment at about 500° C. for about two hours to obtain samples representing second through sixth specific examples of preferred embodiments of the present invention.

These samples were magnetized with a pulsed magnetizing field with a strength of about 3 MA/m and then their magnetic properties were measured using a BH tracer.

TABLE 2

| | Magnet's dimensions | 1st layer (M layer) sputtered | | 2nd layer (RH layer) sputtered | | | |
|---|---|---|---|---|---|---|---|
| | (mm) 10 × 10 × t | Element | Thickness (μm) | Element | Thickness (μm) | Br (T) | HcJ (MA/m) |
| Cmp. Ex. 4 | 5.0 | | | Dy | 8 | 1.37 | 1.27 |
| Ex. 2 | 5.0 | Al | 2.0 | Dy | 8 | 1.39 | 1.40 |
| Ex. 3 | 5.0 | Bi | 0.6 | Dy | 8 | 1.39 | 1.36 |
| Ex. 4 | 5.0 | Zn | 1.0 | Dy | 8 | 1.38 | 1.32 |
| Ex. 5 | 5.0 | Ag | 0.5 | Dy | 8 | 1.40 | 1.39 |
| Ex. 6 | 5.0 | Sn | 1.0 | Dy | 8 | 1.38 | 1.34 |

As is clear from the results shown in Table 2, the coercivities $H_{cJ}$ of the second through sixth specific examples of the present invention were higher than that of the fourth comparative example in which only Dy was diffused with none of those metal layers interposed. This is because by providing the metal layer of Al, Bi, Zn, Ag or Sn, the diffusion of Dy was promoted and Dy could permeate and reach deeper inside the magnet.

Example 7

First, as in the first specific example described above, a number of sintered magnet bodies with a thickness of about 8 mm, a length of about 10 mm and a width of about 10 mm were made. Compared to the first through sixth examples described above, the sintered magnet bodies of this seventh specific example of a preferred embodiment of the present invention had a greater thickness of about 8 mm.

Next, a metal layer was deposited on the surface of these sintered magnet bodies using an electron beam evaporation system. Specifically, the following process steps were carried out.

First, the deposition chamber of the electron beam evaporation system was evacuated to reduce its pressure to about $5\times10^{-3}$ Pa, and then was supplied with high-purity Ar gas with its pressure maintained at about 0.2 Pa. Next, a DC voltage of about 0.3 kV was applied between the electrodes of the deposition chamber, thereby performing an ion bombardment process on the surface of the sintered magnet bodies for about five minutes. This ion bombardment process was carried out to clean the surface of the sintered magnet bodies by removing a natural oxide film from the surface of the magnets.

Subsequently, the pressure in the deposition chamber was reduced to about $1\times10^{-3}$ Pa and then a vacuum evaporation process was carried out at a beam output of about 1.2 A (about 10 kV), thereby depositing an Al layer to a thickness of about 3.0 μm on the surface of the sintered magnet bodies. Thereafter, a Dy layer was deposited in a similar manner to a thickness of about 10.0 μm on the Al layer at a beam output of about 0.2 A (about 10 kV). Subsequently, the magnet bodies were subjected to the same heat treatment as in the first specific example described above, thereby obtaining a sample representing the seventh specific example of a preferred embodiment of the present invention.

The manufacturing process of the fifth comparative example was different from that of the seventh specific example of a preferred embodiment of the present invention in that the process step of depositing the Al layer and the heat treatment process at about 680° C. for about 30 minutes were omitted.

These samples were magnetized with a pulsed magnetizing field with a strength of about 3 MA/m and then their magnetic properties were measured using a BH tracer. The magnetic properties (including remanence $B_r$ and coercivity $H_{cJ}$) of the fifth comparative example and the seventh specific example of a preferred embodiment of the present invention thus measured are shown in the following Table 3.

TABLE 3

| | Magnet's dimensions | 1st layer (M layer) EB evaporated | | 2nd layer (RH layer) EB evaporated | | | |
|---|---|---|---|---|---|---|---|
| | (mm) 10 × 10 × t | Element | Thickness (μm) | Element | Thickness (μm) | Br (T) | HcJ (MA/m) |
| Cmp. Ex. 5 | 8.0 | | | Dy | 10 | 1.38 | 1.22 |
| Ex. 7 | 8.0 | Al | 3.0 | Dy | 10 | 1.39 | 1.37 |

As is clear from the results shown in Table 3, even the magnet body with a thickness of about 8 mm achieved high coercivity $H_{cJ}$ because Al promoted the grain boundary diffusion of Dy and made Dy permeate deeper inside the magnet.

Figure 5:
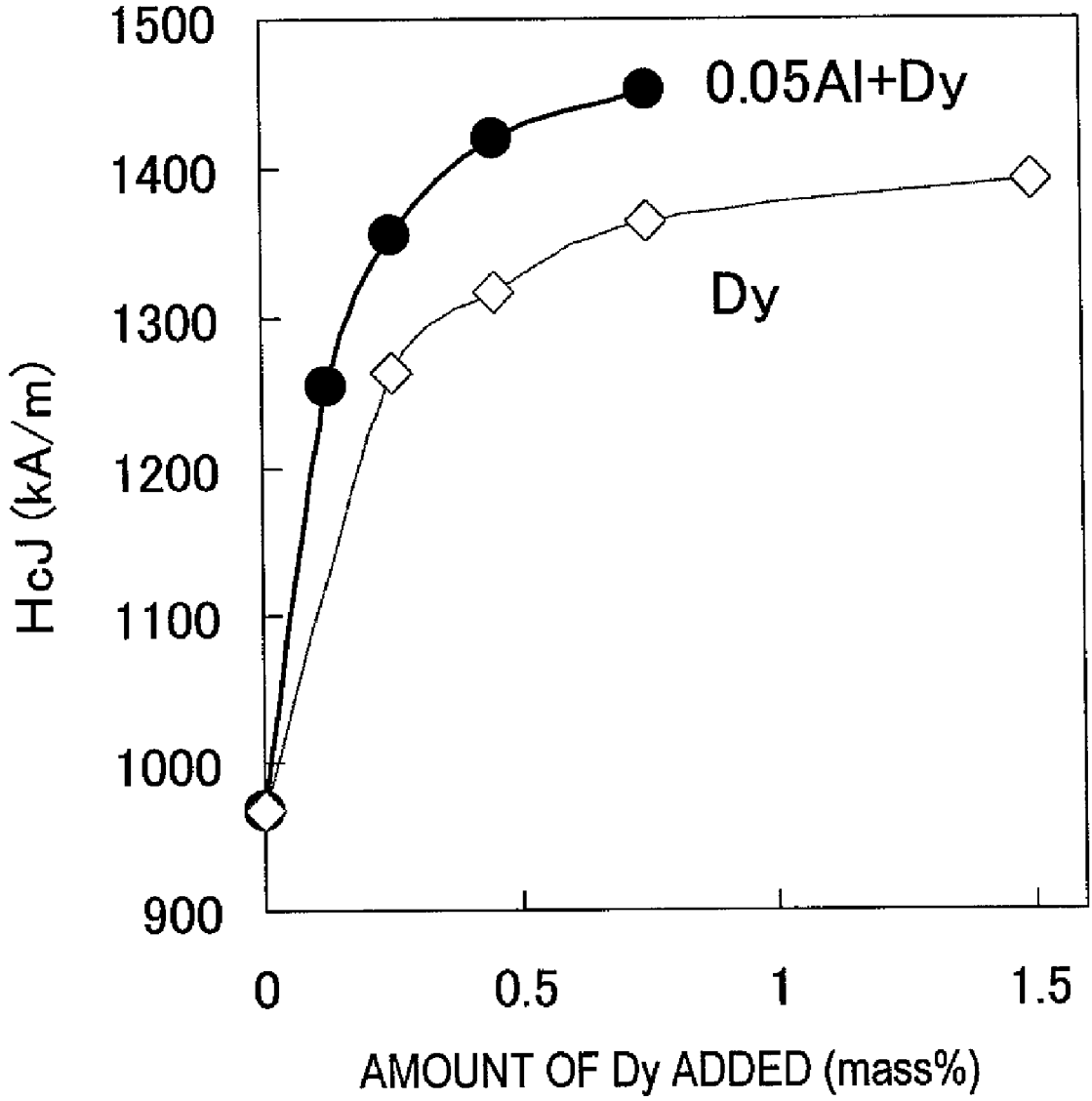
FIG. 5 is a graph showing relationships between the coercivity $H_{cJ}$ and the thickness of the Dy layer.

FIG. 5 is a graph showing relationships between the amount of Dy introduced from the surface of a magnet with a thickness t of about 3 mm by the grain boundary diffusion and the coercivity $H_{cJ}$. As can be seen from FIG. 5, by providing the Al layer, the same degree of coercivity $H_{cJ}$ is achieved by a smaller Dy layer thickness, which would contribute to not only using a heavy rare-earth element RH that is a rare natural resource more efficiently but also cutting down the manufacturing process cost.

As described above, the present inventors confirmed that by carrying out a diffusion process with a layer of a low-melting metal such as Al interposed between the layer of Dy, a heavy rare-earth element, and the sintered magnet, the grain boundary diffusion of Dy was promoted. As a result, the diffusion of Dy can be advanced, and Dy can permeate deeper inside the magnet, at a lower heat treatment temperature than conventional ones. Consequently, the coercivity $H_{cJ}$ can be increased with the decrease in remanence $B_r$ due to the presence of Al minimized. In this manner, the coercivity $H_{cJ}$ of a thick magnet can be increased as a whole while cutting down the amount of Dy that should be used.

It should be noted that according to preferred embodiments of the present invention, the heavy rare-earth element RH has a concentration profile in the thickness direction (i.e., diffusion direction). Such a concentration profile would never be produced in a conventional process in which a heavy rare-earth element RH is added either while the alloy is being melted or after the alloy has been pulverized into powder.

Optionally, to increase the weather resistance of the magnet, the layer of the heavy rare-earth element RH may be coated with a layer of Al or Ni on its outer surface.

According to a preferred embodiment of the present invention, even if the sintered magnet body has a thickness of about 3 mm or more, main phase crystal grains, in which a heavy rare-earth element RH is present at a high concentration on its outer periphery, can be formed efficiently even inside the sintered magnet body, thus providing a high-performance magnet with both high remanence and high coercivity alike.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A method for producing an R—Fe—B based rare-earth sintered magnet, the method comprising the steps of:

providing an R—Fe—B based rare-earth sintered magnet body including, as a main phase, crystal grains of an $R_2Fe_{14}B$ type compound that includes a light rare-earth element RL, which is at least one of Nd and Pr, as a major rare-earth element R;

depositing an M layer, including a metallic element M that is at least one element selected from the group consisting of Al, Ga, In, Sn, Pb, Bi, Zn and Ag, on a surface of the R—Fe—B based rare-earth sintered magnet body;

depositing an RH layer, including a heavy rare-earth element RH that is at least one element selected from the group consisting of Dy, Ho and Tb, on the M layer; and heating the R—Fe—B based rare-earth sintered magnet body, thereby diffusing the metallic element M and the heavy rare-earth element RH from the surface of the R—Fe—B based rare-earth sintered magnet body deeper inside the magnet.

2. The method of claim 1, wherein the R—Fe—B based rare-earth sintered magnet body has a thickness of about 3 mm to about 10 mm.

3. The method of claim 2, comprising the step of setting the weight of the RH layer yet to be diffused within the range of about 0.1% to about 1.0% of the weight of the R—Fe—B based rare-earth sintered magnet body.

4. The method of claim 1, comprising the step of setting the temperature of the R—Fe—B based rare-earth sintered magnet body during diffusion within the range of about 300° C. to less than about 1,000° C.

5. The method of claim 1, wherein the steps of depositing the M layer and the RH layer are carried out by a vacuum evaporation process, a sputtering process, an ion plating process, an ion vapor deposition process, an electrochemical vapor deposition process or a dipping process.

* * * * *